US006173532B1

(12) United States Patent
Beausoleil

(10) Patent No.: US 6,173,532 B1
(45) Date of Patent: Jan. 16, 2001

(54) AUTOMATIC GARAGE DOOR OPENER

(76) Inventor: Armand S. Beausoleil, 1149 E. Carson St., Apt. 1, Long Beach, CA (US) 90807

( * ) Notice: Under 35 U.S.C. 154(b), the term of this patent shall be extended for 0 days.

(21) Appl. No.: 09/389,616

(22) Filed: Sep. 3, 1999

(51) Int. Cl.[7] ..... E05F 11/00

(52) U.S. Cl. ..... 49/199

(58) Field of Search ..... 49/197, 199, 325; 160/188, 201

(56) References Cited

U.S. PATENT DOCUMENTS 2,560,236 * 7/1951 McNinch et al. ..... 49/199 X
2,588,028 * 3/1952 McNinch ..... 49/199
2,661,450 * 12/1953 Moler ..... 49/199 X

* cited by examiner

*Primary Examiner*—Jerry Redman
(74) *Attorney, Agent, or Firm*—Charles H. Thomas

(57) ABSTRACT

A garage door opener is provided with a drive mechanism formed by a chain that runs in a track. The track is mounted on the platform of a mounting support that is hinged to the vehicle entry wall of a garage directly above the garage door opening. The track includes a track opening directed straight out from the vehicle entry wall. The track extends in a curve from the track opening toward the vehicle entry wall, along a first proximal straight section that lies parallel to the vehicle entry wall, around a one hundred eight degree bend, and along another distal straight section that is located parallel to and spaced from the first, proximal section. The chain is formed with large links having flat upper and lower plates. Each link has a hinged side and an unhinged side and the links are joined together at their corners along their hinged sides. The chain can only be bent in an arc that is concave inwardly toward the hinged sides of the links. A reversible drive mechanism drives the chain so that as the garage door is opened, the chain links emanate in straight linear alignment with each other from the track opening and function as a push rod that forces the top of the garage door inwardly toward the interior of the garage. When the garage door is closed, the links of the chain will flex about their corner connections and thereby follow the chain track on the platform. As the garage door approaches a closed position, a lift mechanism is actuated that rotates the platform upwardly through a small arc to allow the top of the garage door to pass therebeneath.

20 Claims, 14 Drawing Sheets

AUTOMATIC GARAGE DOOR OPENER

BACKGROUND OF THE INVENTION

1. Field of the Invention

The present invention relates to an automatic garage door opener for raising and lower a garage door relative to a garage door opening a in a vehicle entry wall of a garage.

2. Description of the Prior Art

Various types of automatic garage door openers have existed for many years. Conventional automatic garage door openers are electromechanical devices which raise and lower a garage door to unblock and block a garage door opening in response to actuating signals. The signals are electrical signals transmitted by closure of a push-button switch through electrical wires or by radio frequency from a battery-operated, remote controlled actuating unit. In either case the electrical signals initiate movement of the garage door from the opposite condition in which it resides. That is, if the garage door is open, the actuating signal closes it. Alternatively, when the garage door is closed, the actuating signal will open the garage door. Once movement has been initiated, the system is deactuated when the garage door movement trips a limit switch as the garage door approaches its open or closed position.

The drive systems for conventional automatic garage door openers are frequently rather large and cumbersome and are difficult for a single individual to install. Conventional drive systems typically include either a very long worm drive or a very long drive through a chain loop tensioned between a pair of sprockets. The chain is connected to the garage door. A typical worm drive shaft is at least about eight feet in length, while the sprockets in a chain loop drive are likewise separated by a distance of at least eight feet. The large distances involved from one end of the drive system to the other makes conventional automatic garage door openers quite difficult for one person to install.

A further disadvantage of conventional automatic garage door opening systems is that they are designed for permanent installation. That is, once the automatic garage door opening system has been installed, it cannot be easily taken down, transported to a new location, and reinstalled. As a consequence, people who rent garages are highly unlikely to purchase a conventional automatic garage door opener since they are fully aware that they will, in all likelihood not be able to take the automatic garage door opener with them should they choose to relocate.

A further disadvantage of conventional garage door opening systems is that they typically extend down into the interior of the garage at least about six inches. As a consequence, they cannot be installed in garages having low overhead clearances since they extend downwardly a distance sufficient to create an overhead obstruction. On the other hand, where a garage has a particularly high ceiling, conventional garage door openers cannot be utilized without first creating a support framework that extends downwardly into the interior of the garage to provide a mounting base for a conventional worm drive or chain loop drive system.

SUMMARY OF THE INVENTION

The present invention is an automatic garage door opener with a drive mechanism that operates on principles entirely different from those of conventional garage door openers. Unlike conventional worm drive and loop chain drive systems, the automatic garage door opener of the present invention does not involve, long, ungainly drive mechanisms. To the contrary, the garage door opener of the present invention is quite compact and is totally mounted on a platform that is less than four feet in length and less than foot in width. As a consequence, the unit can be easily installed by a single individual.

Installation of the garage door opener of the invention is extremely simple. The device typically takes only about twenty minutes to install, as contrasted with the hours of time that are normally expended by purchasers of conventional automatic garage door openers in the installation process.

A further advantage of the present invention is that the entire mechanism is mounted on the wall of the garage right above the vehicle entry door opening. Therefore, there is no supporting structure required at a longitudinal distance within the interior of the garage remote from the garage door opening. Thus the system is not in any way dependent upon the height of the garage ceiling or the height of any framework above the vehicle storage area. As a consequence, it can be installed and operated in a garage having an extremely low overhead clearance, and also in a garage having an unusually high ceiling.

The garage door opener of the invention is installed as a single unit. Prior to installation, all of the operating components of the garage door opener are joined together. This enhances the ease of installation and also makes the unit easily removable and transportable. Thus, the garage door opener of the invention does not become a permanent fixture in the garage, but rather is merely an accessory that can be hung on the wall above the garage door opening. It therefore lends itself to use and reuse in different locations. This is a particularly popular feature with garage tenants, as contrasted with garage owners, since the garage door opener is an item of personal property that can be easily moved from one garage to the next.

In one broad aspect the present invention may be considered to be an improvement in a garage door opener for automatically opening and closing a garage door relative to a garage door opening in a vehicle entry wall of a garage having an interior. The improve is comprised of an opener mechanism which includes a track, a chain, and a reversible drive system. The track is secured to the vehicle entry wall above the garage door opening. The track extends in a curve and includes a track opening directed away from the vehicle entry wall and toward the interior of the garage. The chain is not formed into a loop, but rather has a first and second ends. The first end of the chain is connected to the top of the garage door. The second end of the chain is always engaged with the track. The chain includes a plurality of links that have corners which are hinged together in articulated fashion to permit relative movement of the links. Specifically, the links may be moved between straight linear alignment with each other and curvature in only one single direction from linear alignment with each other. That is, the links can undergo articulated movement in one direction relative to a straight line, but not any other.

A reversible drive system advances the chain out from the track opening and into the garage interior so that all of the chain links that are located between the track opening and the top of the garage door reside in straight, linear alignment with each other. Alternatively, the reversible drive system retracts the chain from the garage interior onto the track so that the links follow the curve in the track.

The chain is constructed so that as the links are brought into straight, linear alignment with each other as the emanate from the track opening. The links are provided with complementary fastening tabs and also with transverse abutment shoulders at their leading and trailing ends. When the links of the chain are oriented in straight, linear alignment, the fastening tabs reside in abutment against the abutment shoulders.

In another aspect the invention may be considered to be a garage door opener for automatically raising and lower a garage door relative to a garage door opening in a vehicle entry wall of a garage having an interior. The garage door opener is comprised of a support platform, a track, a drive chain, and an electrically operated bidirectional drive system.

The platform is mounted in the garage interior on the entry wall above the garage door opening. The track is located on the support platform and has one open end directed out from the entry wall toward the interior of the garage. The drive chain has links that are joined together in articulated fashion. The links include stops located so as to permit articulated movement of the links between alignment with each other in a straight line and deflection to a single side of that straight line. The drive chain has a leading end and a trailing end. The leading end has an extremity that is coupled to the garage door. The trailing end is constrained to move within the track.

The drive system is mounted on the support platform and is engaged with the drive chain. The drive system moves the drive chain between extended and retracted positions relative to the track. In the extended position, the leading end of the drive chain extends linearly out of the open end of the track and away from the support platform and into the interior of the garage. In the retracted position, the chain is drawn back onto the track with the extremity of the leading end residing at the open end of the track.

The drive chain employed is formed of links that are of considerable size, unlike the links of drive chains that are formed into a loop in conventional chain loop drive systems. The load upon the chain is a compressive load, rather than a tensile load as in conventional chain loop drive systems. It is necessary for the links of the drive chain to be high enough and wide enough so that the chain will not twist as it is pushed by the drive mechanism into the interior of the garage to open the garage door. Chain links must therefore have a considerable mass, and the links must be of considerable length, width, and height.

Preferably, the drive chain is formed of links each having a pair of generally rectangular-shaped link plates that are parallel to each other and held in rigid, spaced separation from each other by link pins and link pin sleeves. The link plates are preferably at least about one and one-half inches in length and three-quarters of an inch in width. The link plates in each link are preferably separated by a distance of at least about three-quarters of an inch.

The first end of the drive chain may be considered to be a leading end and is coupled to the top of the garage door. The second or trailing end of the chain always remains engaged with the track. Each of the chain links has a hinged side with corner extremities and an opposing unhinged side. The links are hinged to each other at the corner extremities of the hinged sides of the links. Also, each of the links is provided with stops in the form of abutment shoulders formed by fastening tabs projecting longitudinally beyond the abutment shoulders. The links are thereby rotatable relative to each other in articulated fashion only between positions of straight linear alignment with each other and positions in which the unhinged sides of a adjacent links are laterally displaced from each other.

A drive chain having this configuration and connected in this manner is constrained so that as the links are forced out of the track opening, they are brought into linear alignment with each other. The lateral force on the links is such as to tend to try to force the unhinged side of the links to rotate toward each other. However, due to the stops on the links, the unhinged sides thereof cannot move beyond linear alignment in the lateral direction in which forces are exerted. As a consequence, the links emanating from the track opening remain in linear alignment with each other and function as a push rod that forces the top of the garage door to which the leading end of the drive chain is connected toward the interior of the garage and away from the entry wall in which the vehicle entry opening is formed.

On the other hand, when the links of the drive chain are drawn back onto the track, the curvature of the track is such as to accommodate the articulated movement of the chain links so that the unhinged sides thereof rotate away from each other. This allows the drive chain to be drawn through a curved path from alignment substantially perpendicular to the vehicle entry wall through a curved section of the track, and onto a first straight, horizontally aligned section of the track that is located proximate to and lies parallel to the vehicle entry wall. To make the unit more compact, a one hundred eighty degree bend section is formed in the track. The bend section is connected to the first straight section remote from the curved section and a second straight section of the track is also provided. The second straight section is connected to the one hundred eighty degree bend section and is spaced from and parallel to the first straight section, as well as to the wall of the garage in which the vehicle entry opening is formed.

The straight portion of the drive chain extending from the track opening inwardly into the interior of the garage and which terminates at the leading end of the drive chain that is coupled to the garage door, is close to perpendicular alignment to the wall in which the vehicle entry opening is formed. However, it is advantageous for the alignment of the straight portion of the drive chain to be varied somewhat, particularly as the garage door approaches its closed position blocking the vehicle entry opening. For this reason the automatic garage door opener of the invention is preferably further comprised of suspension linkage that is attached to the vehicle entry wall above the mounting support and to a suspension link coupling mount projecting upwardly from the platform bearing the track at a location above the platform spaced from the vehicle entry wall in the interior of the garage. The suspension linkage preferably includes a platform lift actuating lever that has upper and lower ends with a fulcrum located therebetween. The lift actuating lever is rotatably coupled at its fulcrum to the suspension link coupling mount for rotation about a horizontal platform lift axis that lies above the platform.

The platform itself is also rotatable attached to the vehicle entry wall. The platform lift axis is parallel to and lies above the platform axis of rotation. The suspension linkage further includes a rigid lift stroke control link, one end of which is rotatably connected relative to the vehicle entry wall above the platform axis of rotation. The other end of the rigid lift stroke control link is rotatably connected to the upper end of the platform lift actuating lever.

The first end of the drive chain includes a laterally projecting platform lift actuator lug that contacts the lower end of the platform lift actuating lever and rotates it to thereby raise the platform. This occurs as the reversible drive mechanism retracts the drive chain and as the first, or leading end of the drive chain, approaches the track. The platform is thereby tilted upwardly from the vehicle entry wall about its platform axis of rotation as the garage door closes, so as to clear the top of the garage door as it passes therebeneath.

The invention may be described with greater clarity and particularity by reference to the accompanying drawings.

DESCRIPTION OF THE EMBODIMENT

Figure 1:
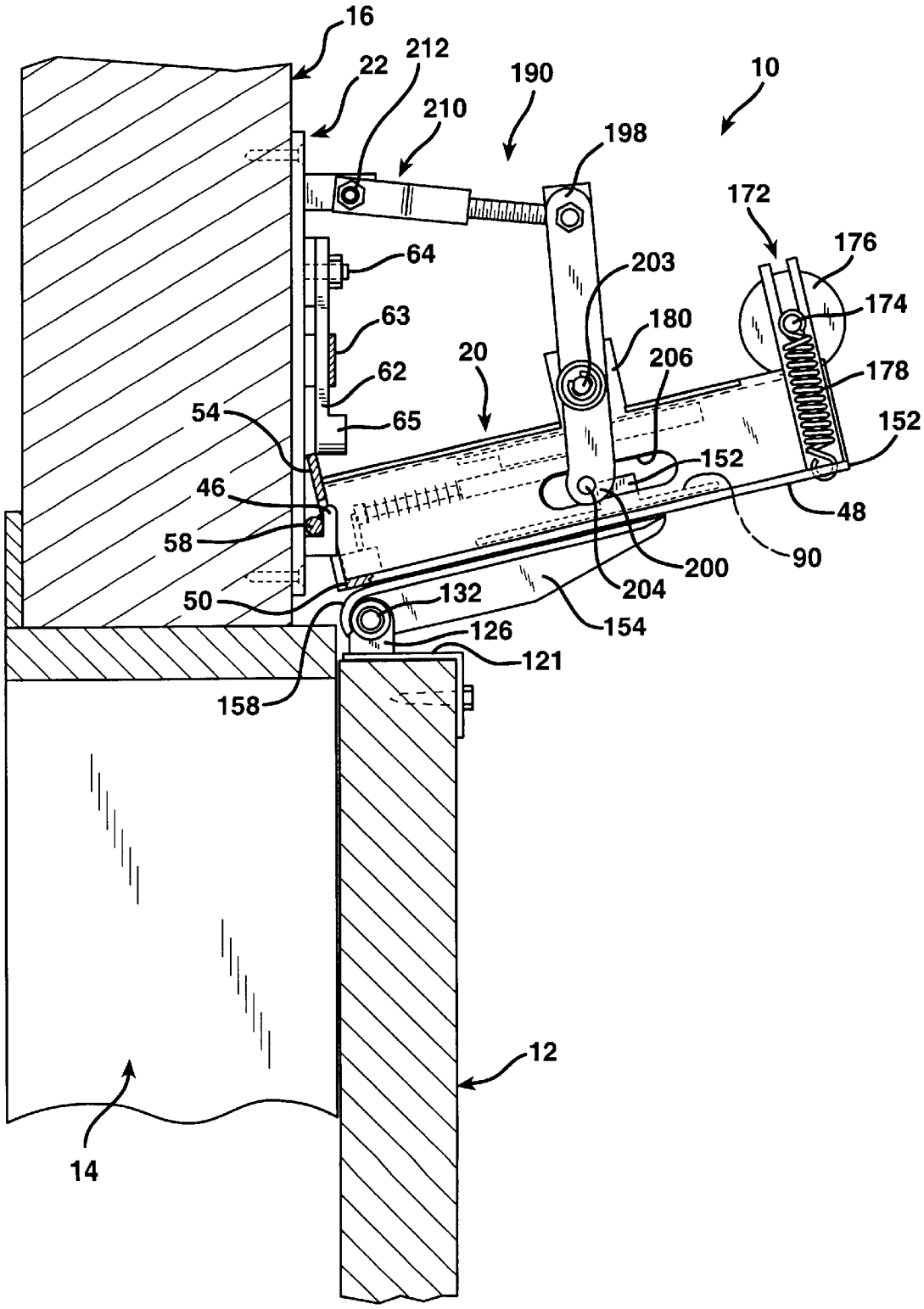
FIG. 1 is a side sectional elevational view of the garage door opener of the invention shown with the garage door in a closed position blocking the vehicle entry opening.
Figure 2:
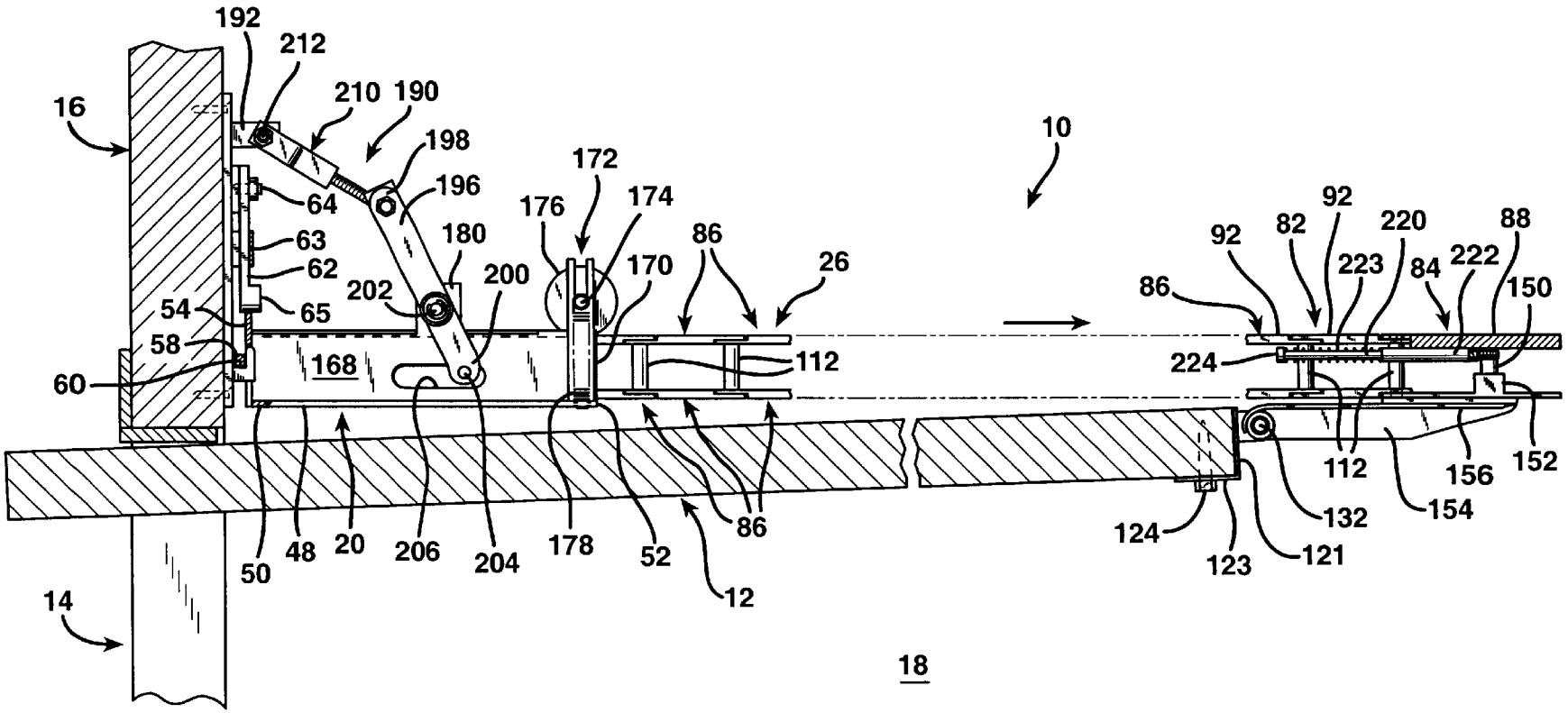
FIG. 2 is a side elevational sectional view of the garage door opener of FIG. 1 shown with the drive chain in the extended condition and with the garage door fully open.

FIGS. 1 and 2 are side elevational views illustrating the garage door opener of the invention generally at 10. The garage door opener 10 automatically opens and closes a garage door 12 relative to a garage door opening 14 in a vehicle entry wall 16 of a garage having an interior indicated generally at 18. The garage door opener 10 lifts the garage door 12 from a closed position blocking the garage door opening 14 as indicated in FIG. 1 to an open position elevated within the interior 18 of the garage, as illustrated in FIG. 2.

Figure 3:
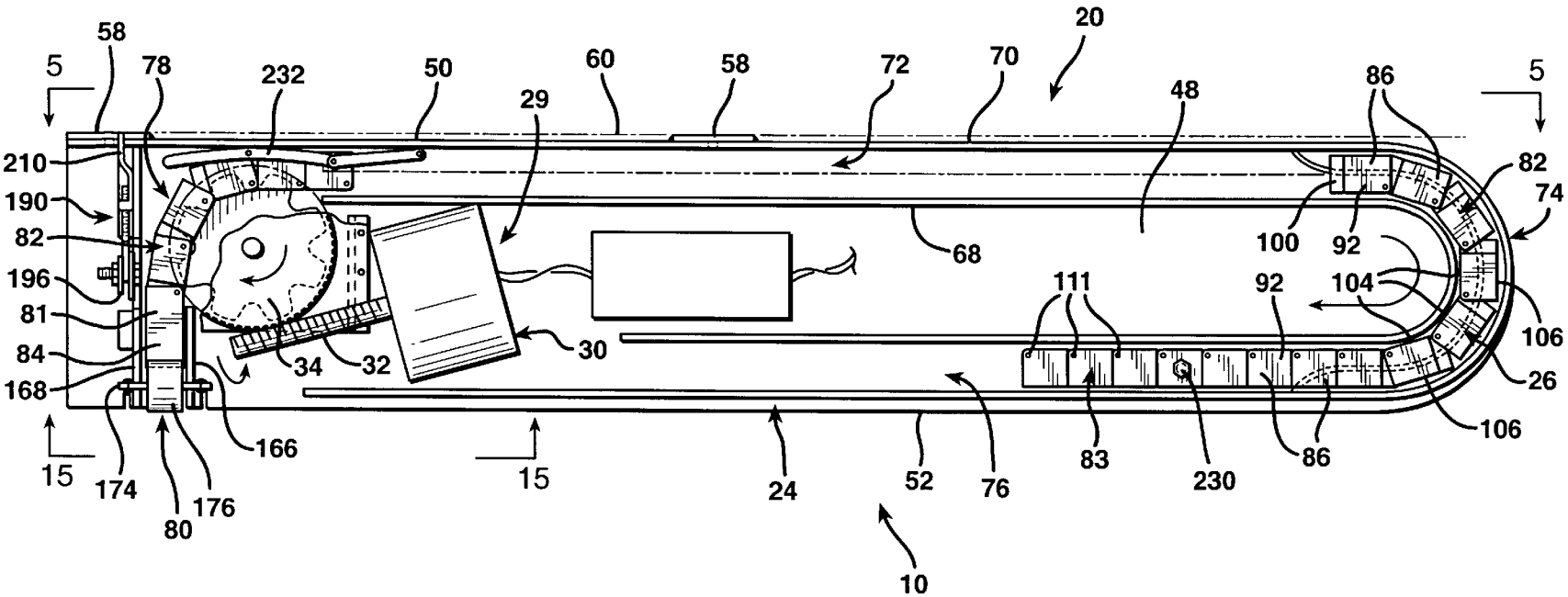
FIG. 3 is a top plan view of the garage door opener of the invention shown as it appears when the garage door is closed as in FIG. 1.
Figure 4:
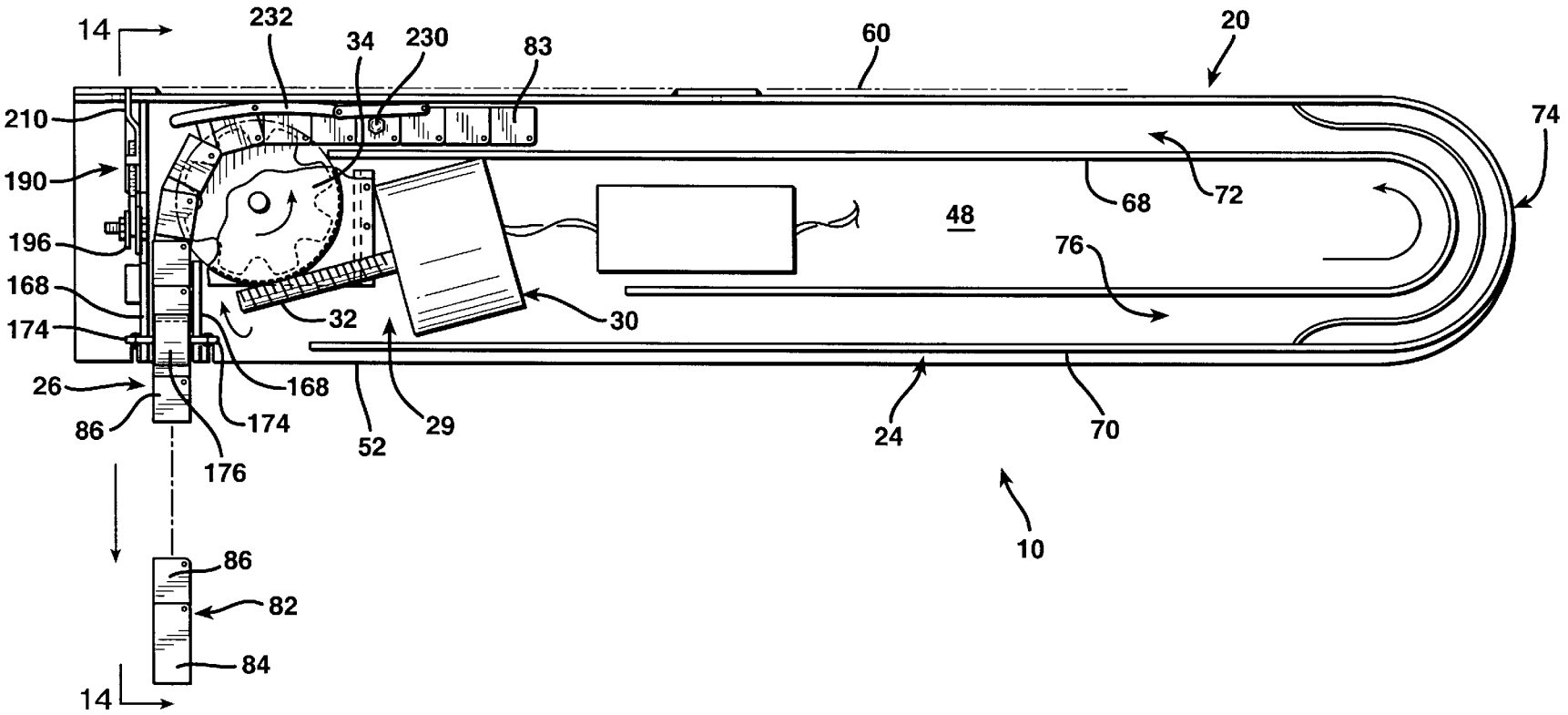
FIG. 4 is a top plan view of the garage door opener of the invention shown as it appears when the garage door is opening.
Figure 9:
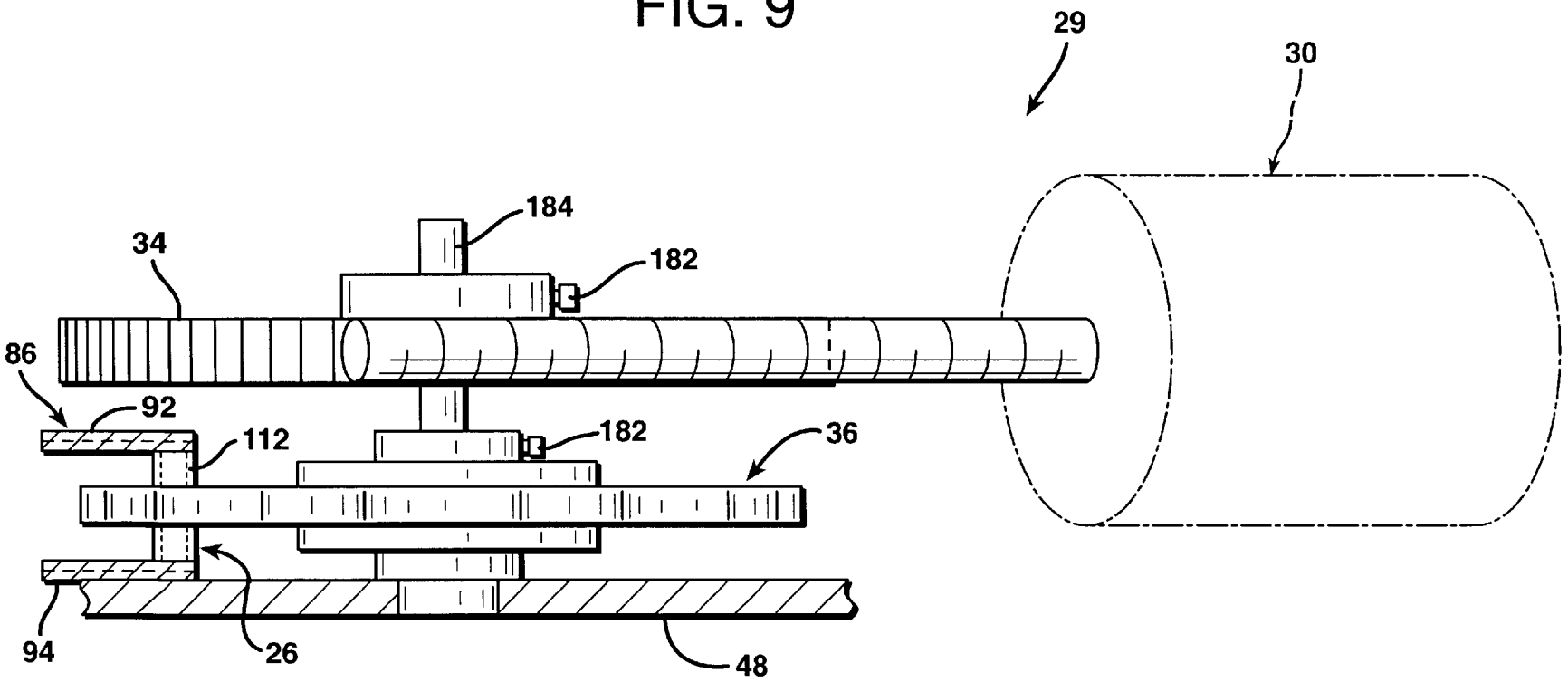
FIG. 9 is a front elevational detail showing the drive motor and drive transmission system of the automatic garage door opener of FIGS. 1–4.

The garage door opener 10 includes a mounting support 20, a wall anchoring mounting bracket 22, a track 24 visible in FIGS. 3 and 4, a drive chain 26, and a reversible drive mechanism 29 including a motor 30 having a worm drive axle 32, a spur gear 34 engaged by the worm drive 32, and a chain drive sprocket 36, best shown in FIG. 9. The spur gear 34 and the chain drive sprocket 36 are both secured to a vertically oriented force transmission shaft 184, which is mounted for rotation relative to the mounting support 20.

The wall anchoring mounting bracket 22 is a flat, L-shaped sheet metal structure having a relatively short, vertically oriented leg 40 and a horizontally directed leg 42. The short, vertical leg 40 is about eight inches long, while the longer, horizontal leg 42 is about twenty-eight inches in length. The mounting bracket 22 is secured to the inside surface of the vehicle entry wall 16 by lag screws or molly bolts 44. The mounting bracket 22 is provided with two upwardly turned hooks 46 welded to the wall mount bracket 22 and projecting outwardly therefrom into the garage interior 18. The hooks 46 are spaced about twenty inches apart on the lower, elongated leg 42 of the wall mounting bracket 22. There is a gap of about one-quarter of an inch between the exposed flat surface of the wall mounting bracket 22 and the upwardly projecting tips of the hooks 46.

The rigid mounting support 20 includes a flat, elongated platform 48 that is located proximate to the vehicle entry wall 16 and which extends toward the interior 18 of the garage. The platform 48 forms part of the mounting support 20 that is connected to the vehicle entry wall 16 about a horizontal platform axis of rotation 60 that is parallel to the vehicle entry wall 16. Although the platform 48 normally resides in a generally horizontal orientation, perpendicular to the vehicle entry wall 16 throughout most of the travel of the chain 26, it is desirable for the platform 48 to be rotatable upwardly about the horizontal platform axis of rotation 60 from a horizontal disposition perpendicular to the vehicle entry wall 16 to a limited degree to permit passage of the top 66 of the garage door 12 therebeneath.

The platform 48 has an inboard side 50 located proximate to and parallel to the vehicle entry wall 16, and an opposite, parallel outboard side 52 spaced from the inboard side 50 a distance of about seven and one-half inches and from the vehicle entry wall 16 a distance of about eight inches. At the inboard side 50 of the platform 48, there is a mounting strip 54, about two inches in height, that extends from the left-hand edge of the platform 48, as viewed in FIGS. 3 and 4, and is about forty inches in overall length. The mounting strip 54 is oriented perpendicular to the platform 48 and is either formed by a right angle bend in the same sheet of metal forming the platform 48 or is rigidly secured thereto, as by welding.

Figure 5:
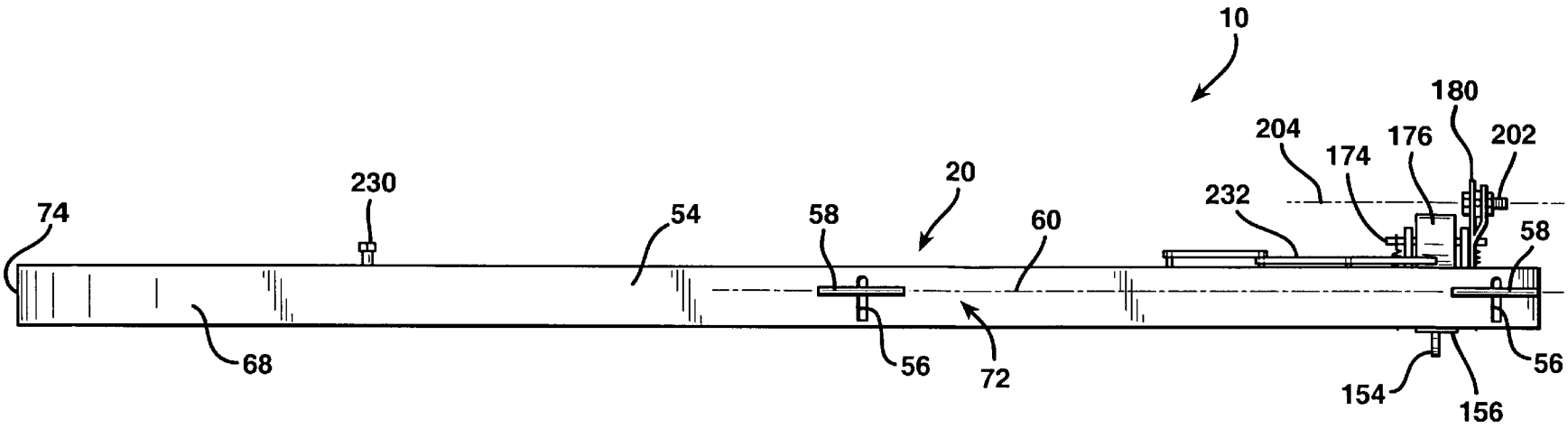
FIG. 5 is a rear elevational view of the rigid mounting support for the automatic garage door opener of the invention taken along the lines 5—5 of FIG. 3.

A pair of vertical slots 56 are defined in the mounting strip 54. One of these slots is located quite close to the right-hand end of the mounting strip 54, as viewed in FIG. 5. The slots 56 are spaced approximately nineteen inches apart. Short, separate, horizontal hinge rods 58, each about one-quarter of an inch in diameter are welded to the outer surface of the mounting strip 54 that faces the vehicle entry wall 16. These hinge rods 58 are located slightly nearer to the upper ends of the slots 56 on the mounting strip 54 than they are to the platform 48. There is sufficient space between the rods 58 and the closed upper ends of the slots 56 to permit clearance of the tips of the hooks 46, however.

As illustrated in FIGS. 2, 6, 7, and 14, the hooks 46, the slots 56, and the hinge rods 58 are configured to form hinge connections that mount the mounting support 20 to the vehicle entry wall 16. Together the hinge rods 58 and the hooks 46 form hinge connections between the mounting support 20 and the wall anchoring mounting bracket 22 that is secured to the vehicle entry wall 16. The hinge connections permit limited rotational movement of the platform 48 relative to the vehicle entry wall 16. The wall mount hinge rods 58 span the hook-receiving openings 56. The hook-receiving openings 56 receive the extremities of the hooks 46 therewith and permit rotation of the mounting support 20 relative to the hooks 46. This rotational movement occurs about the horizontal platform axis of rotation 60. The mounting support 20 can rotate upwardly so that the platform 48 moves from a horizontal orientation as illustrated in FIG. 2, through an arc of between about ten and fifteen degrees, as illustrated in FIG. 1.

Figure 7:
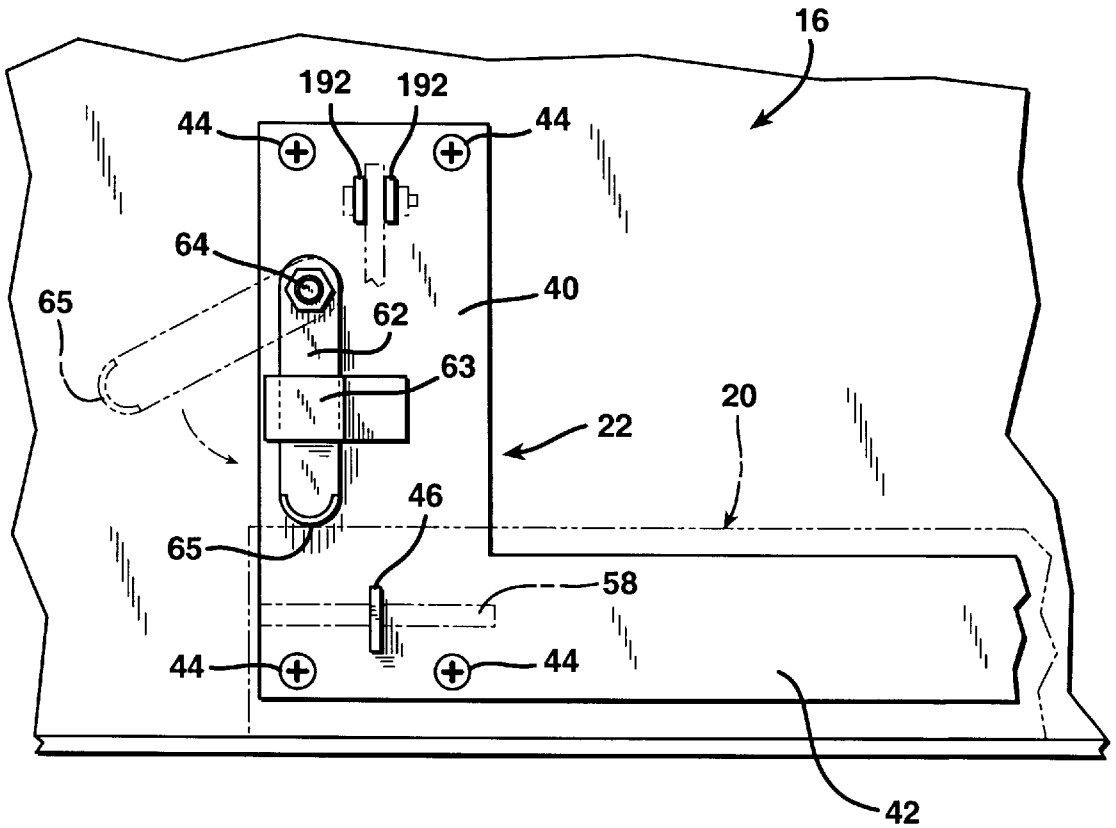
FIG. 7 is a front elevational view of the portion of the mounting support bracket shown in FIG. 6.
Figure 6:
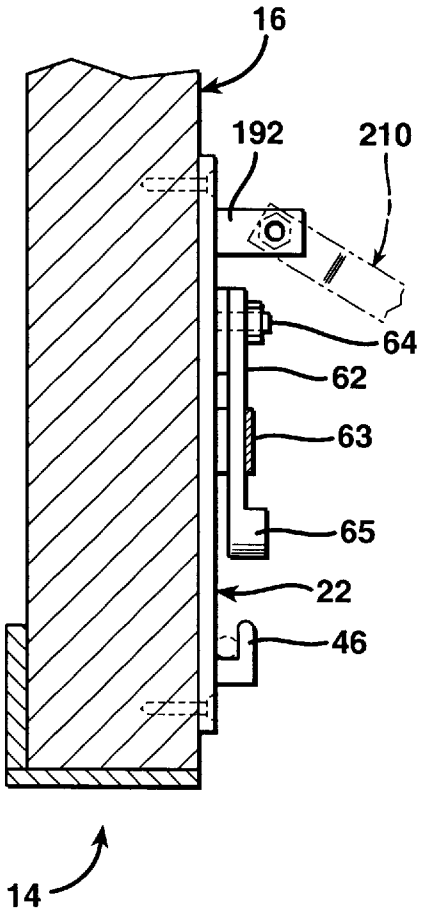
FIG. 6 is a sectional elevational detail of the mounting bracket showing one of the mounting support hooks and a locking mechanism for holding the mounting support of the automatic garage door opener of the invention in position.

As illustrated in FIGS. 6 and 7, the mounting bracket 22 is provided with a latch lever 62, mounted for rotation about a horizontal axis by means of a bolt assembly 64. The latch lever 62 includes an enlarged latching lug 65 that projects toward the garage interior 18 out of the plane of the otherwise flat latching lever 62. The mounting bracket 22 is also provided with a retaining bracket that forms a seat 63 for the latch lever 62.

To mount the door opener 10 on the vehicle entry wall 16 once the mounting bracket 22 has been installed, it is merely necessary to disengage the latch lever 62 from its seat 63 to permit the mounting support 20 to be positioned so as to engage the hooks 46. The hinge pins 58 rest upon and are supported by the cradles formed between the hooks 46 and the flat surface 40 of the mounting bracket 22 from which the hooks 46 project. The latching lever 62 is then swung from the position indicated in phantom in FIG. 7 to the seated position, indicated in solid lines in that drawing figure. The latching lug 65 thereupon bears against the top edge of the mounting strip 54, thus preventing the hinge rods 58 from lifting free of the hooks 46 when the mounting support 20 moves in rotation about the horizontal platform axis of rotation 60.

As long as the latch lever 62 remains engaged in the seat 63, the mounting support 20 will remain attached to the mounting bracket 22. If the latch lever 62 is released, as indicated in phantom in FIG. 7, the mounting support 20 can be easily lifted free of the hooks 46 and removed from the vehicle entry wall 16.

Figure 14:
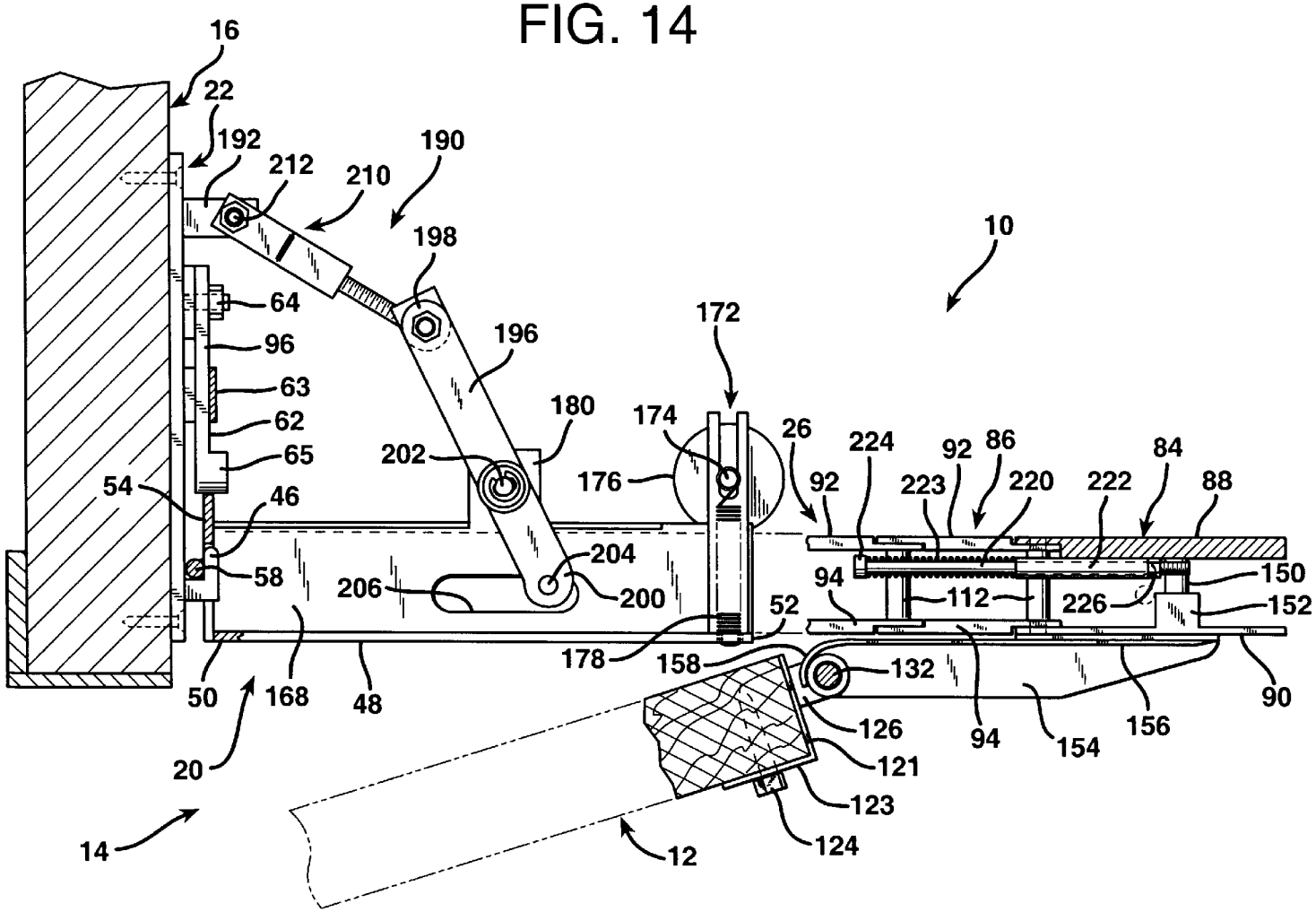
FIG. 14 is a side elevational sectional view taken along the lines 14—14 of FIG. 4 illustrating the automatic garage door opener of the invention at an intermediate position as it moves the garage door between an open and a closed position.

The track 24 is mounted upon the platform 48, which in turn is secured to the vehicle entry wall 16 as indicated. The platform 48 is rotatable about the horizontal platform axis of rotation 60 relative to the vehicle entry wall 16 upwardly from a horizontal position, as illustrated in FIG. 2, to an inclined position that permits passage of the top 66 of the garage door 12 therebeneath, as illustrated in FIGS. 14 and 1.

The track 24 is located atop the platform 48 and is formed by the mounting strip 54 and other upright steel strips that are welded to the platform 48 and which define an inner track wall 68 and an outer track wall 70. Together, with the floor of the platform 48, the track walls 68 and 70 provide the track 24 with a concave, upwardly facing, channel-shaped cross section.

The track 24 includes a first, proximal straight section 72, a one hundred eighty degree arc bend section 74, a second straight track section 76, a curved track section 78, and a track opening 80. The tracking opening 80 is directed toward the garage interior 18. The curved track section 78 extends in a arc of at least ninety degrees from the track opening 80. Preferably, the curved track section 78 covers no more than a ninety degree arc, whereupon it joins the first straight track section 72. The first straight track section 72 extends horizontally from the curved track section 78 and is parallel to and is located proximate to the vehicle entry wall 16. The proximal, straight section 72 that is connected to the curved section 78 is closely proximate to the inboard side 50 of the platform 48. The one hundred eighty degree arc bend section 74 of the track 24 is connected to the first straight traction section 72 remote from the curved section 78. The second straight track section 76 is connected to and extends from the one hundred eight degree bend section 74 back toward the track opening 80. The second straight track section 76 is spaced from and parallel to the first straight track section 72. The bend section 74 is located between the straight proximal track section 72 and the straight distal track section 76.

The track 24 accommodates and laterally constrains movement of the drive chain 26. As illustrated in FIGS. 3 and 4, the drive chain 26 is formed with a first end 82 and a second end 83. The first, leading end 82 of the chain 26 has an end member 84 at its extremity. The end member 84 is joined to an adjacent one of a plurality of chain links 86. Preferably, the chain 26 is constructed with about forty of the links 86, in addition to the end member 84.

The end member 84 and all of the links 86 are formed with upper and lower rectangular plates that are joined together in mutually parallel, spaced relationship from each other. The end member 84 is formed of steel and has a flat, upper plate 88 and a flat, lower plate 90. The plates 88 and 90 are each approximately one and one-quarter inches in width and three inches in length. Similarly, the chain links 86 each have a flat, upper, rectangular plate 92 and a flat, lower, rectangular plate 94. The plates 92 and 94 are each about two inches in length and one and one-quarter inches in width.

Figure 10:
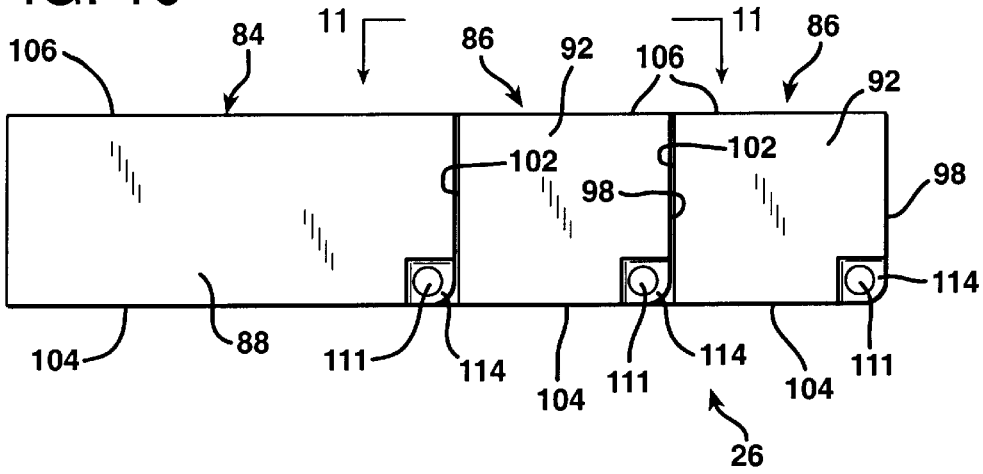
FIG. 10 is a top plan detail illustrating the first, leading end of the drive chain employed in the automatic garage door opener of FIGS. 1–4 with the adjoining chain links linearly aligned in a straight line.
Figure 10A:
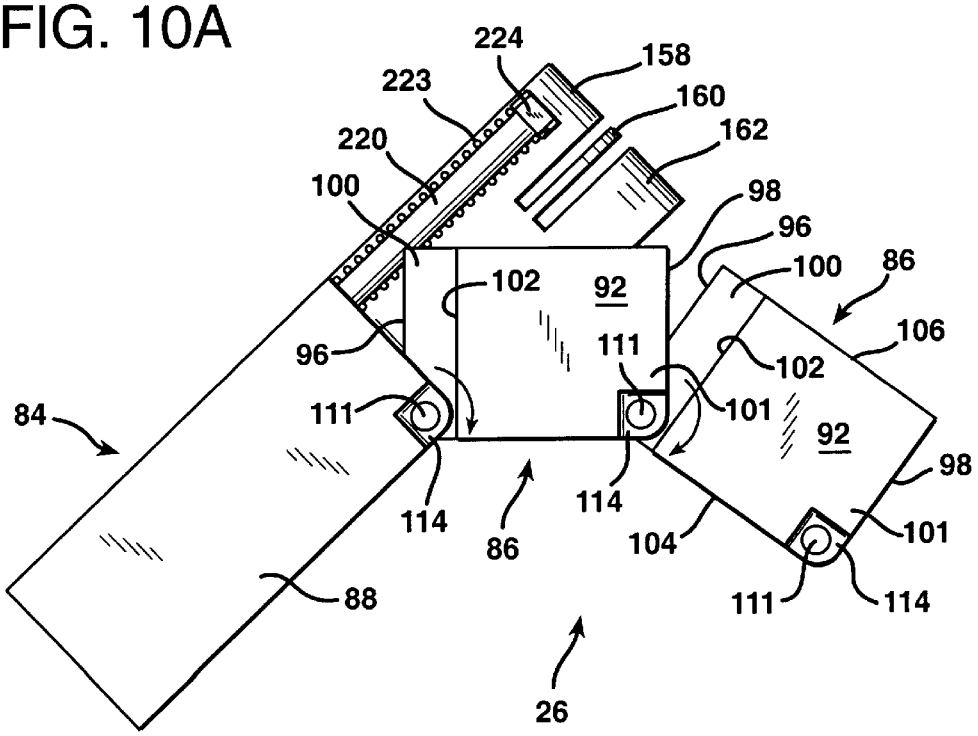
FIG. 10A is a top plan view of the links and end member at the leading end of the drive chain deflected to a single side of the straight linear alignment shown in FIG. 10 as permitted by the link hinge pin connection.
Figure 11:
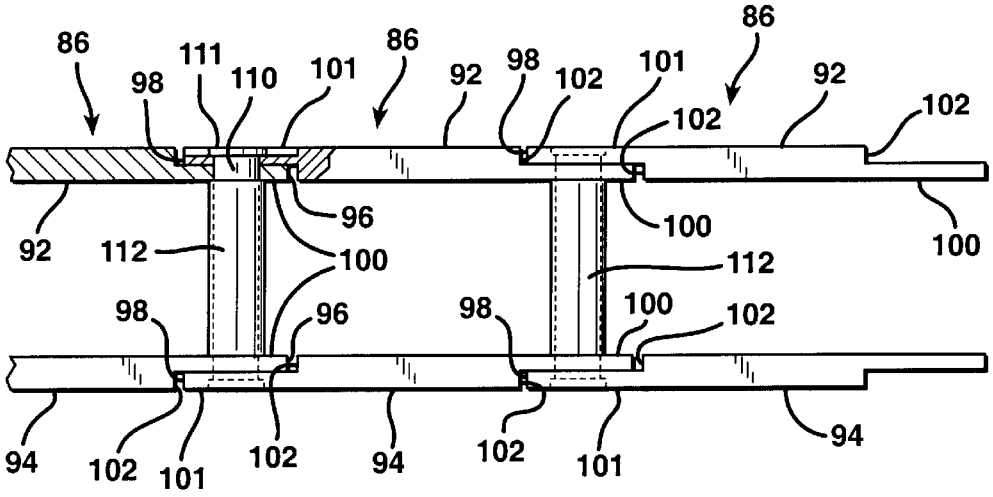
FIG. 11 is a side elevational view of a portion of the drive chain partially broken away, taken along the lines 11—11 of FIG. 10.

As illustrated in FIGS. 10, 10A, and 11, each of the link plates 88, 90, 92, and 94 has a leading end 96 and a trailing end 98. The leading and trailing ends of both the upper link plates 92 and the lower link plates 94 are all configured with longitudinally extending hinge tabs 100 and 101, respectively, and transverse extending abutment shoulders 102 that delineate the hinge tabs 100 and 101. The trailing ends 98 of the plates 88 and 90 are also configured with longitudinally extending hinge tabs 100 that delineate transverse abutment of stop ledges 102. The hinge tabs 100 of the leading ends 96 of the chain links 86 are complementary to the hinge tabs 101 of the trailing ends 98 of the end member plates 88 and 90 and the chain link plates 92 and 94. That is, and as best illustrated in FIG. 11, the hinge tabs 100 of the leading ends 96 face upwardly and underlie the downwardly facing hinge tabs 101 of the trailing ends 98 of the link plates 88, 90, 92, and 94. The hinge tabs 100 of the leading ends 96 of the link plates 92 and 94 overlap the hinge tabs 101 of the trailing ends 98 of the link plates that are located immediately adjacent thereto.

Each of the chain links 86, and also the end member 84, has a hinged side 104 and an unhinged side 106. At each hinged side 104 of the links 86 there are corner extremities on the hinge tabs 100 and 101. The leading edge hinge tabs 100 of the upper and lower hinge plates 92 and 94 of each link 86 are joined together at these corner extremities by hinge pin sleeves 112 that are welded thereto and located between the upper and lower hinge plates 92 and 94 of each chain link 86. The hinge pin sleeves 112 are about one and one-sixteenth inches long and define central hinge pin openings therethrough about one-quarter of an inch in diameter. The sleeves 112 act as spacers to hold the plates 92 and 94 of each chain link 86 a fixed distance apart and in mutually parallel alignment.

The links 86 and the end member 84 are further comprised of hinge connections that extend perpendicular to and which join together the plates 88, 90, 92, and 94 by joining the hinge tabs 100 and 101 of adjacent leading and trailing ends 96 and 98 of the plates 88, 90, 92, and 94. Hinge pins 110 pass through the chain link hinge pin sleeves 112 and through openings in the structure of both the leading edge tabs 100 and the trailing edge tabs 101 of the next adjacent chain link 86. The hinge pins 110 have heads 111 at both ends that are flattened and reside atop corner recessed decks 114 defined on the outwardly facing surfaces of each of the trailing edge tabs 101 at the hinged sides 104 of the chain links 86. The flattened heads of the hinge pins 110 do not protrude above the outer surfaces of the chain link plates 92 and 94. The links 86 are thereby hinged to each other at the corner extremities of their hinged sides 104 by the hinge pins 110 and by the hinge pin sleeves 112. Together the link hinge pins 110 and the link sleeves 112 hingedly join and maintain a uniform, spaced distance of separation between the upper and lower link plates in the chain 26. In this way the links 86 are rotatable in articulated fashion within a single, generally horizontal plane between positions of straight, linear alignment with each other as depicted in FIG. 10, and positions in which the unhinged sides 106 of adjacent links 86 are displaced from each other, as illustrated in FIG. 10A. The fastening tabs 100 and 101 are displaced from the abutment shoulders 102 at the unhinged sides 106 of adjacent chain links 86 that are on the curved track section 78 or the bend track section 74.

The chain links 86 and the end member 84 are hinged together at the corners 114 along their common, hinged sides 104. The hinge pins 110 join the hinge tabs 100 and 101 of adjacent leading edges 96 and trailing edges 98 of the link plates 92, 94, 144, and 146 at the hinged side 104 of the links 86 and 84. In this way the fastening tabs 100 of the leading ends 96 of the links 86 reside in abutment against the abutment shoulders 102 of the trailing ends of the fastening tabs 101 of the links 86 and against the abutment shoulder 148 of the trailing end of the end member 84. The fastening tabs 100 and 101 reside in abutment against the abutment shoulders 102 when the adjacent links 86 and the end member 84 are in straight linear alignment with each other, as illustrated in FIGS. 2 and 10. This interfering relationship between the fastening tabs 100,101 and the abutment shoulders 102 and 148 thereby prevents convex outwardly bending of the chain 26 to the common, unhinged side 106 of the chain links 86 and 84.

The chain links 86 and the end member 84 of the chain 26 can be moved into straight linear alignment as illustrated in FIG. 10, or into a curve in which the unhinged sides 106 are disposed convex outwardly and the hinged sides 104 are disposed concave inwardly. However, since the chain links 86 and the end member 84 are hinged on their hinged sides 104, the chain 26 cannot be flexed in the direction opposite that depicted in FIG. 10A.

Figure 12:
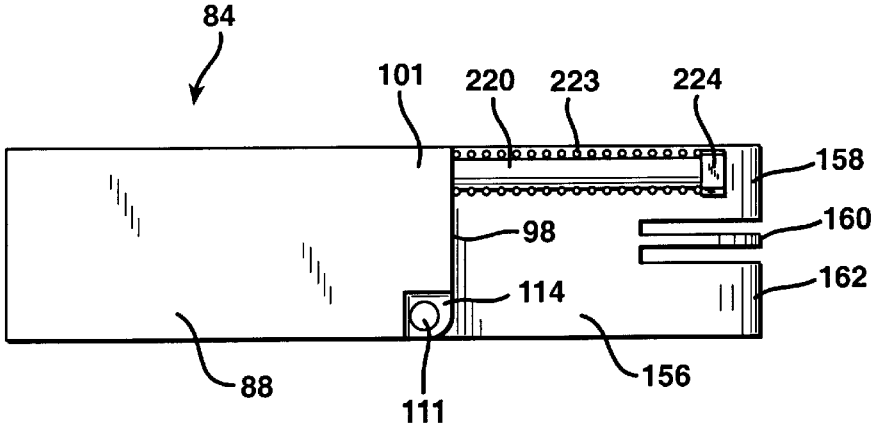
FIG. 12 is a bottom plan view of the end member at the leading end of the drive chain of the invention.
Figure 13:
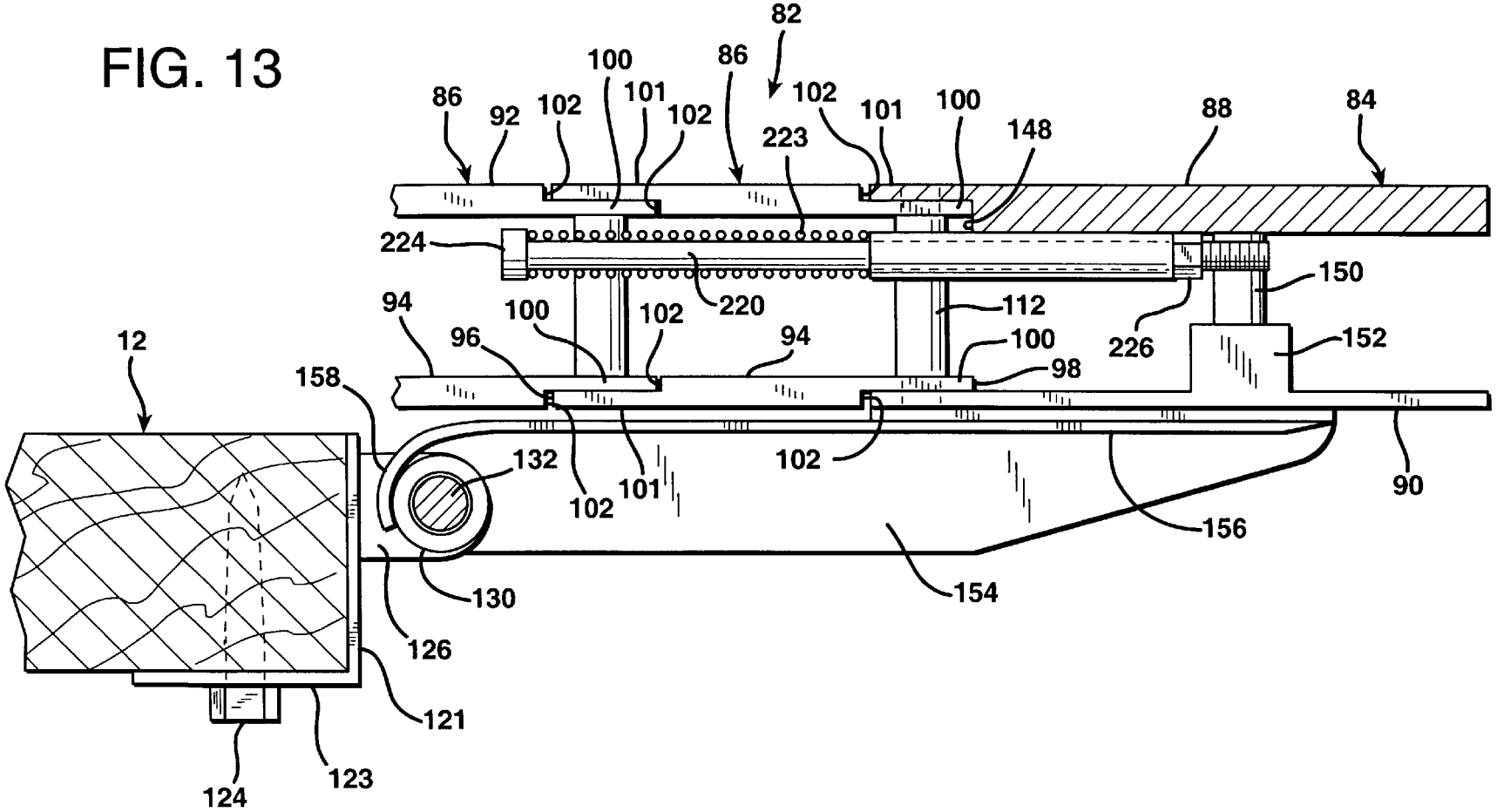
FIG. 13 is a side elevational detail view showing the connection of the end member of the leading end of the drive chain of the invention coupled to the top of the garage door, which is in the open position.

The end member 84 is illustrated in detail in FIGS. 12 and 13. Like the chain links 86, the end member 84 has upper and lower link plates indicated at 88 and 90, respectively. The link plates 88 and 90 of the end link 84 are configured somewhat differently from the upper and lower link plates 92 and 94 of the chain links 86, however.

The rectangular upper plate 88 of the end link 84 has a trailing edge with a rearwardly projecting fastening tab 101, just like the upper plates 92 of chain links 86. The upper link plate 88 also defines a transverse abutment shoulder 148, against which the forwardly projecting fastening tab 100 of the upper plate 92 of the adjacent chain link 86 bears when the end member 84 and the immediately adjacent chain link 86 are linearly aligned in a straight line, as illustrated in FIGS. 10 and 13.

Forward of the trailing ends of the plates 88 and 90 of the end member 84, the plates 88 and 90 are provided with a spacer post 150. The spacer post 150 is welded to both the upper plate 88 and the lower plate 90 of the end member 84. The post 150 serves to maintain the upper link plate 88 and lower link plate 90 in mutually parallel alignment a fixed distance apart of about one and one-sixteenth inches. The end member 84 is also equipped with a lift actuating lug 152 that is welded to and projects upwardly from the lower plate 90 of the end member 84.

The fastening tab 101 of the upper link plate 88 is secured to the trailing end 98 of the lower link plate 90 and to the leading end 96 of the immediately adjacent chain link 86 by a link hinge pin 110 and by the sleeve 112 of that link 86 in the same manner that the links 86 are joined to each other.

Unlike the chain links 86, the end member 84 further includes a narrow guide fin 154 that is welded to and depends from the underside of the lower plate 90. The guide fin 154 is a thin, narrow, longitudinally elongated, vertically oriented strip of steel that extends both downwardly and rearwardly from the lower plate 90 of the end member 84 and beneath the chain links 86 immediately adjacent thereto. The guide fin 154 has a circular opening defined therethrough at its rear extremity. Projecting laterally outwardly on both sides of the guide fin 154 are a pair of flanges 156 that are spaced from and parallel to the lower plate 90. The guide flanges 156 are formed as planar, plate-like structures on both sides of a slot in the forward end of a flange plate. At the rear extremity the flange plate forms curved fingers 158, 160, and 162, as best depicted in FIGS. 12 and 13. The curved fingers 158, 160, and 162 at the rear extremities of the flange plate define slots therebetween.

Figure 16:
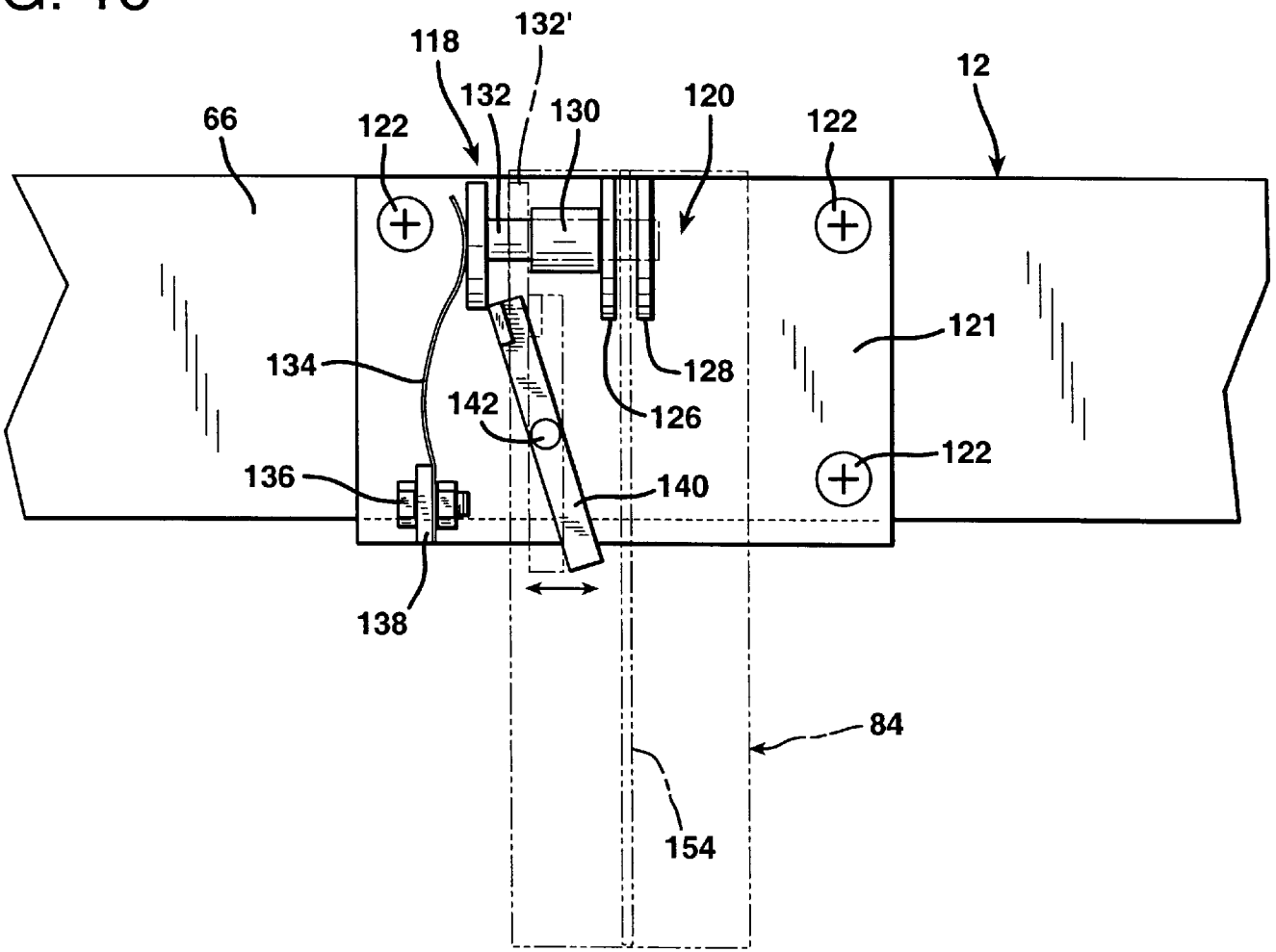
FIG. 16 is a plan detail of the top of the garage door, shown in the closed position with the end member of the leading end of the drive chain that is connected thereto shown in phantom.

The end member 84 at the leading end of the chain 26 is attached to the top edge 66 of the garage door 12 by a garage door coupling member 118, as best illustrated in FIGS. 13 and 16. The garage door coupling member 118 includes an L-shaped plate 120, one leg 121 of which passes across the top edge 66 of the garage door 12, and the other leg 123 of which extends a short distance down the inside surface of the garage door 12 from the top edge 66 thereof. The L-shaped plate 120 is attached to the top edge 66 of the garage door 12 by wood screws 122 and to the upper center of the surface of the garage door 12 by lag bolts 124.

The garage door coupling member 118 is provided with a releaseable connector mechanism that includes a pair of mutually parallel ears 126 and 128 projecting upwardly perpendicular to the top edge leg 121 of the L-shaped plate 120. The ears 126 and 128 have central openings defined therethrough which reside in coaxial alignment with each other. The ear 126 further includes a sleeve 130 welded to its surface opposite the ear 128. A coupling pin 132 is mounted for reciprocal movement within the sleeve 130. A leaf spring 134 is also mounted to the angle plate leg 121 by means of a bolt 136 and by a tang 138 that projects outwardly perpendicular to the mounting plate leg 121. The leaf spring 134 acts against the head of the coupling pin 132 to normally bias the coupling pin 132 inwardly so that its shank projects through the openings in both the ears 126 and 128. This normal position of the coupling pin 132 is indicated in phantom at 132' in FIG. 16.

The coupling member 118 also includes a release lever 140 that can act in opposition to the leaf spring 134. The release lever 140 is rotatably mounted to the angle plate leg 121 by means of a mounting post 142. The release lever 140 can be rotated about the mounting post 142 in a counter-clockwise direction to the solid line position illustrated in FIG. 16 to overcome the bias of the leaf spring 124, and pull the shank of the coupling pin 132 out from the opening in the ear 128 and clear of the gap between the ears 126 and 128 in order to release the end member 84 at the leading end 82 of the chain 26. This is done to disengage the garage door opener 10 from the garage door 12 so that the garage door 12 can be opened or closed in the event of a power failure. The circular opening in the guide fin 154 of the leading end member 84 has a diameter large enough to receive the shank of the coupling pin 132 of the garage door coupling mechanism 118 therethrough. The spaces between the flanges 158, 160, and 162 are of a width sufficient to accommodate the thicknesses of the ears 126 and 128 of the garage door coupling mechanism 118 as the top 66 of the garage door rotates relative to the end member 84.

Near its left-hand edge, as viewed in FIGS. 3 and 4, the mounting support 20 includes a pair of support plates 166 and 168 which project up from the platform 48 in perpendicular orientation relative thereto. The support plates 166 and 168 are oriented parallel to each other and reside in vertical planes that are perpendicular to the vehicle entry wall 16. The support plates 166 and 168 are spaced apart from each other a distance of about one and one-half inches and define therebetween the track opening 80.

Near their forward edges, the support plates 166 and 168 are provided with a pair of upright standards 170 which define upwardly opening forks 172 at their upper extremities. The forks 172 receive the horizontally projecting stub axles 174 of a rubber roller 176 which is mounted for rotation between the forks 172. The rubber roller 176 is about one and one-half inches in diameter and is biased toward the platform 48 by means of a pair of coil springs 178. The upper ends of the coil springs 178 are secured to the stub axles 174 of the roller 176, while the lower ends of the springs 178 are secured to the platform 48. The rubber roller 176 is thereby biased downwardly against the top of the chain link 86 or end member 84 located immediately below it, toward the platform 48, within the limits allowed by the depth of the forks 172.

The inside upright support plate 176 extends about three inches to the rear of the outboard side 52 of the platform 48 and then terminates. The outside upright support 176 extends all the way to the mounting strip 54 of the mounting support 20 and is welded thereto. The outside mounting support 168, at a distance of about three inches from the outboard side 52 of the platform 48, defines an upwardly projecting fulcrum tang 180. The fulcrum tang 180 serves as a suspension link coupling mount.

Figure 8:
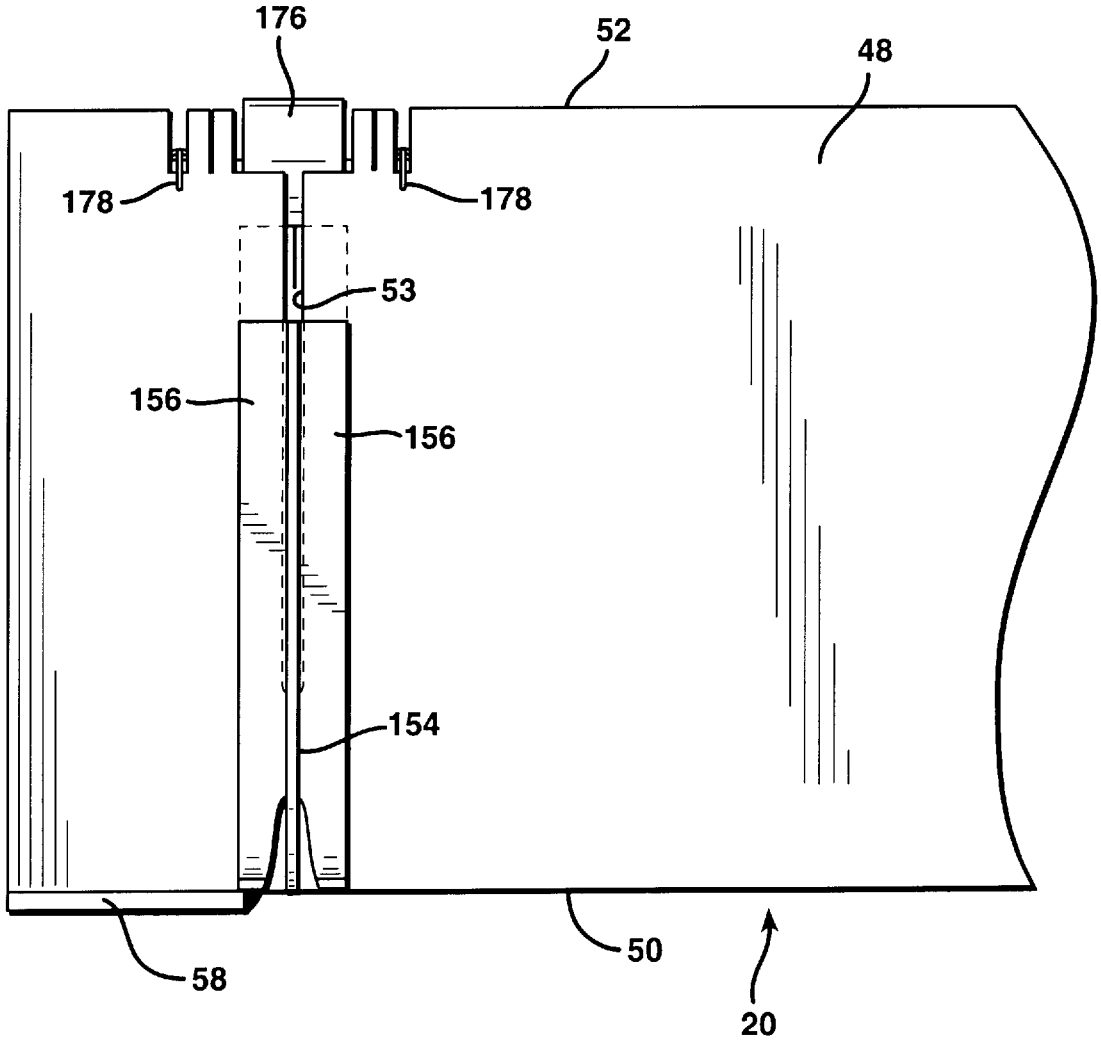
FIG. 8 is a bottom plan view of the left-hand portion of the automatic garage door opener as shown in FIG. 3.

The platform 48 defines within its structure a narrow, elongated slot 53 that projects rearwardly from the outboard side 52 of the platform 48 a distance of about five and one-half inches, as illustrated in FIG. 8. The slot 53 terminates about two inches from the inboard side 50 of the platform 48 to which the mounting strip 54 is secured. The slot 53 is just wide enough to receive and guide the guide fin 150 to carry the end member 84 at the leading end 82 of the chain 26 straight back as the end member 84 passes through the track opening 80.

Figure 15:
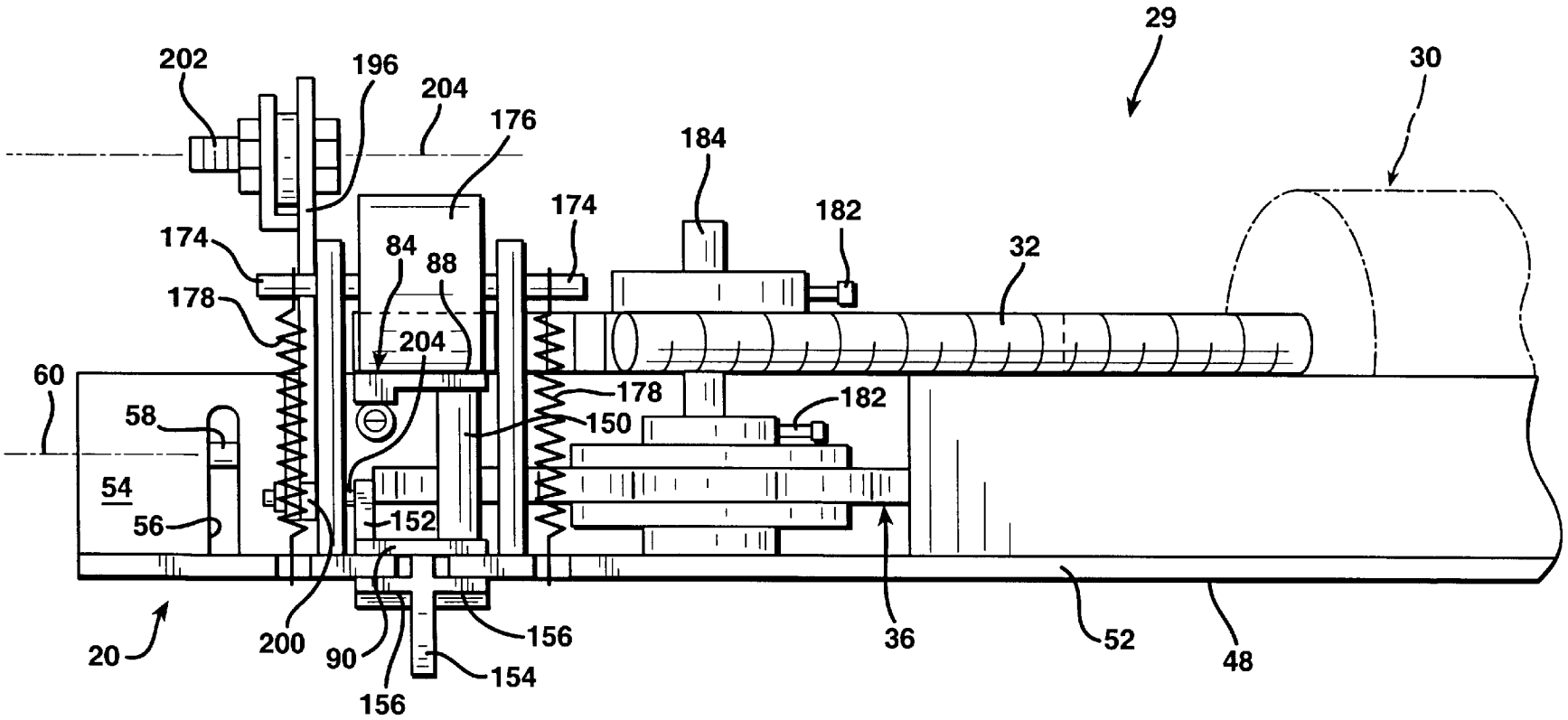
FIG. 15 is a front elevational detail taken along the lines 15—15 of FIG. 3.

As best illustrated in FIGS. 8 and 15, the guide slot 53 in the platform 48 is aligned with and lies in the same vertical plane as the track opening 80. The guide fin 154 follows the guide slot 53 in the platform 48 when the reversible drive system of the garage door opener 10 fully retracts the chain 26 into the track 24.

As the garage door 12 is closed, the hinge connection between the guide fin 154 and the garage door coupling pin 132 of the releaseable garage door opener connection 118 permits relative rotational movement between the end member 84 of the chain 26 and the garage door 12. As this relative rotational movement occurs, the gaps between the fingers 158, 160, and 162 at the hinged end of the guide fin 154 accommodate and receive the ears 126 and 128 on the garage door coupling 118.

The electric motor 30 is a conventional, reversible, alternating current one-quarter horsepower motor that is mounted on the platform 48. The chain sprocket 36 and the spur gear 34 that is engaged with the worm drive shaft 32 both include hubs that are secured by set screws 182 to a transmission shaft 184 that projects upwardly from and is rotatably mounted relative to the platform 48. The axis of rotation of the power transmission shaft 184 is perpendicular to the plane of the platform 48. The sprocket 36 is a conventional chain sprocket and includes teeth that accommodate and engage the sleeves 112 of the chain links 86 and the spacer post 150 of the end member 84. The pitch diameter of the chain sprocket 136 is about two inches.

The automatic garage door opener is also preferably provided with a suspension linkage indicated generally at 190. The suspension linkage 190 is connected to the platform 48 at a location remote from the inboard side 50 thereof. Specifically, one end of the suspension linkage 190 is connected to the suspension link coupling mount formed by the fulcrum tang 180. The suspension linkage 190 is anchored relative to the vehicle entry wall 16 at its other end by an attachment to a pair of horizontally projecting suspension link mounting ears 192. The ears 192 are both vertically aligned and mutually parallel to each other and project outwardly from the upper arm 4 of the mounting bracket 22 at a distance of about six inches above the horizontal platform axis of rotation 60.

The suspension linkage 190 is comprised of a platform lift actuating lever 196 and a rigid lift stroke control link 210. The lift actuating lever 196 has an upper end 198 and a lower end 200 and a fulcrum located between the upper and lower ends 198 and 200. The platform lift actuating lever 196 is mounted relative to the platform 48 at its fulcrum by means of a fulcrum hinge connector 202 that passes through the fulcrum of the lift actuating lever 196 and through the fulcrum tang 180 that projects upwardly from the platform 48. The lift actuating lever 196 thereby rotates about a horizontal platform lift axis 204 that is located above and is parallel to the platform axis of rotation 60, as indicated in FIG. 15.

At its lower end 200, the platform actuating lever 196 has a horizontally projecting stud 204 that extends through an elongated cam slot 206 defined in the support plate 168. The cam slot 206 is about two inches in length. The stud 204 projects laterally into the path of movement of the lift actuating lug 152 rising from the lower plate 90 of the end member 84 at the leading end 82 of the chain 26.

The rigid lift stroke control link 210 is rotatably connected to the upper end 198 of the platform lift actuating lever 196 and to the vehicle entry wall 16 above the platform axis of rotation 60. The rigid lift stroke control link 210 is preferably formed as a turnbuckle so that it has an adjustable length. To adjust the length of the turnbuckle 210, the bolt 212 that rotatably secures the upper end of the turnbuckle 210 to the mounting ears 192 must be loosened and the internally tapped portion of the turnbuckle is advanced onto or backed off from the externally threaded rod portion thereof to decrease or increase, respectively, the length of the lift stroke control link formed by the turnbuckle 210. Adjustment of the length of the turnbuckle 210 thereby allows adjustment of the extent to which the first end member 84 of the chain 26 rotates the platform 48 about the platform axis of rotation 60, as will hereinafter be described.

The suspension linkage 190 aids in bearing the weight of the garage door opener mechanism, and the springs 178 urge the biasing roller 176 against the upper link plates 90 of the chain links 86 as they pass therebeneath. The chain 26 passes between the platform 48 and the biasing roller 176 in moving under the control of the reversible drive system of the invention. In this way the biasing roller 176 maintains the links 86 and the end member 84 of the chain 26 at the track opening 80 in close proximity to the platform 48, and prevents the chain 26 from rising out of the track 24. As the end member 84 reaches the platform 48, the lower link plate 90 of the end link 84 passes across the top of the platform 48, while the flanges 156 emanating laterally from the guide fin 154 pass beneath the platform 48.

As the chain 26 approaches the fully retracted position depicted in FIG. 3, the end member 84 at the first or leading end 82 of the chain 26 pushes the lower end 200 of the platform lift actuating lever 196 along the cam slot 206 and toward the vehicle entry wall 16, as illustrated in FIGS. 2, 14, and 1. This lifting action occurs when the lift actuating lug 152 projecting upwardly from the lower link plate 90 of the end member 84 moves toward the vehicle entry wall 16 and pushes the stud 204 of the platform lift actuating lever 196 inwardly along the cam slot 206 and toward the vehicle entry wall 16. When this occurs the stud 204 is constrained to longitudinal movement relative to the platform 48 by the cam slot 206. As a result, the platform lift actuating lever 196 is rotated in a clockwise direction about the fulcrum hinge connector 202 from the position indicated in FIG. 14 to the position illustrated in FIG. 1, thus raising the platform 48 upwardly out of the path of the top of the garage door 12.

The arc through which the platform 48 is rotated is controlled by the effective length of the turnbuckle 210. The shorter the distance between the hinge connections 198 and 212, which is the effective length of the lift stroke control link formed by the turnbuckle 210, the greater the arc of rotation of the mounting support 20 about the platform axis of rotation 60. Conversely, if the effective length of the lift stroke control link 210 is lengthened, the arc of upward rotation of the platform 48 from its normal, horizontal position will be reduced. The effective length of the turnbuckle 210, that is the distance between the hinge connections 198 and 212, may be adjusted as required for clearance of the top 66 of the garage door 12 in each individual installation.

The latch 62 on the mounting bracket 22 interacts with the mounting strip 54 to ensure that the hooks 46 remain engaged with the wall mount hinge rods 58 despite the limited degree of rotation of the garage door opener support 20 relative to the mounting bracket 22. As the platform 48 is rotated upwardly about the platform axis of rotation 60, the latch 62 on the mounting bracket 22 interacts with the upper edge of the mounting strip 54. That is, the lug 65 on the end of the latch 62 bears against the upper edge of the mounting strip 54 and keeps the hinge rods 58 from rising above the tips of the hooks 46.

The end member 84 also includes an externally threaded door closure limit switch actuating rod 220 that is mounted in a barrel 222 welded to the underside of the upper plate 88 of the end member 84, as illustrated in FIG. 13. The threaded rod 220 is not threadably engaged with the barrel 222, but is reciprocally movable within the barrel 222. A coil spring 223 is disposed about the portion of the threaded rod 220 between the barrel 222 and the actuating tip 224 at one end of the rod 220. The coil spring 223 exerts a force that urges the actuating tip 224 toward the garage entry wall 16.

A jam nut 226 is threaded onto the other end of the threaded rod 220 on the other side of the barrel 222 to limit the extent to which the spring 223 causes the rod 220 to protrude from the barrel 222 toward the vehicle entry wall 16. As the end member 84 approaches the vehicle entry wall 16 when the garage door 12 is being closed, the tip 224 of the rod 220 actuates a conventional electrical limit switch (not shown) to shut off the motor 30 and reverse the electrical contacts for the signals to the motor 30 just as the garage door 12 reaches the closed position shown in FIG. 1. The resilient mounting of the actuating rod 220 relative to the barrel 222 provided by the spring 223 provides a sufficient cushion to prevent the limit switch from being damaged by an excessive impact from he actuating tip 224.

When the garage door 12 is initially closed, as illustrated in FIG. 1, and the drive mechanism 29 is actuated to open it, the motor 30 is actuated to advance the chain 26 out of the track opening 80 into the garage interior 18. The chain 26 then proceeds along the track 24 in the direction indicated in FIG. 4. The reversible drive mechanism of the invention advances the first end 82 of the drive chain 26 into the garage interior 18 so that the end member 84 and the chain links 86 of the drive chain 26 emanate from the track opening 80 in straight, linear alignment with each other within the garage interior 18 beyond the track opening 80, as illustrated in FIGS. 2 and 4.

The reversible drive mechanism of the invention alternatively retracts the chain links 86 and the end member 84 of the drive chain 26 onto the track 24 so that they are drawn into the track opening 80 to follow the track 24. The chain links 86 all follow the curved track section 78, while the end member 84 travels in a straight line to the end of the guide slot 53, as illustrated in FIG. 8.

A limit switch actuating post 230 is provide on one of the links 86 atop or near the trailing end 83 of the chain 26. The actuating post 230 projects upwardly from the upper plate 92 of one of the links 86 and interacts with an articulated limit switch actuating mechanism 232, shown in FIGS. 3 and 4. That is, as the garage door 12 reaches the open position illustrated in FIG. 2, the actuator post 230 operates the spring-loaded limit switch mechanism 232 to move it from the position shown in FIG. 3 to the position shown in FIG. 4. This shuts off the drive signal to the motor 30, and also reverses the signal contacts to the motor 30, so that when the motor 30 is next actuated it will close the garage door 12, rather than open it. The limit switches and the signal reversing switches are conventional in nature and need not be described in detail herein.

The first end member 84 of the drive chain 26 is attached to the garage door 12 by the coupling pin 132 that extends through the opening in the guide fin 154. The opposite, or second end, 83 of the chain 26 is always engaged with the track 24. The reversible drive motor 30, through the worm drive shaft 32, the spur gear 34 with which it is engaged, and the sprocket 36, are engaged with the drive chain 26. Specifically the teeth of the sprocket 36 engage the sleeves 112 that are disposed about the hinge pins 110 of the links 86 and also the spacer post 150 of the end member 84.

Undoubtedly, numerous variations and modifications of the invention will become readily apparent to those familiar with garage door openers. Various mechanical equivalents may be substituted for the suspension linkage 90, the garage door coupling 118, and for the various other elements of the invention. Accordingly, the scope of the invention should not be construed as limited to the specific embodiment depicted and described.

What is claimed is:

1. In combination a garage door and a garage door opener for automatically opening and closing said garage door relative to a garage door opening in a vehicle entry wall of a garage having an interior, the improvement comprising an opener mechanism that includes:

a track secured to said vehicle entry wall above said garage door opening and said track extends in a curve and includes a track opening directed away from said vehicle entry wall and toward said interior of said garage, a chain having first and second ends wherein said first end of said chain is connected to the top of said garage door and said second end of said chain is always engaged with said track, and wherein said chain includes a plurality of links that have corners which are hinged together in articulated fashion to permit relative movement of said links between straight, linear alignment with each other and curvature in only one single direction from linear alignment with each other, and a reversible drive system that advances said chain out from said track opening and into said garage interior so that all of said chain links that are located between said track opening and said top of said door reside in straight, linear alignment with each other as aforesaid, and that alternatively retracts said chain from said garage interior onto said track so that said links follow said curve in said track.

2. A combination according to claim 1 wherein said curve in said track extends in an arc of ninety degrees and said track includes a proximal straight section located adjacent to said curve and extending parallel to said vehicle entry wall.

3. A combination according to claim 2 wherein said track includes a distal straight section extending parallel to said vehicle entry wall and a bend that extends in an arc of one hundred eighty degrees, and said bend is located between said straight proximal and straight distal sections.

4. A combination according to claim 2 wherein said track is mounted upon a platform that is secured to said vehicle entry wall.

5. A combination according to claim 4 wherein said platform has an inboard side located proximate to said vehicle entry wall and an opposite outboard side located remote from said vehicle entry wall, and said inboard side of said platform is secured to said vehicle entry wall by wall mount hinge connections, whereby said platform is rotatable about a horizontal platform axis of rotation relative to said vehicle entry wall upwardly from a horizontal disposition in order to permit passage of said top of said garage door therebeneath, and further including suspension linkage connected to said platform at a location remote from said inboard side thereof and anchored relative to said vehicle entry wall to aid in bearing the weight of said opener mechanism.

6. A combination according to claim 5 wherein said suspension linkage is comprised of a platform lift actuating lever having upper and lower ends and a fulcrum located between said upper and lower ends, and said platform lift actuating lever is mounted to said platform at its fulcrum for rotation about a horizontal platform lift axis that is parallel to said platform axis of rotation, and further comprising a rigid lift stroke control link that is rotatably connected to said upper end of said platform lift actuating lever and to said vehicle entry wall above said platform axis of rotation, and said first end of said chain pushes said lower end of said platform lift actuating lever toward said vehicle entry wall when said reversible drive system fully retracts said chain.

7. A combination according to claim 6 wherein said lift stroke control link has an adjustable length, thereby allowing adjustment of the extent to which said first end of said chain rotates said platform about said platform axis of rotation.

8. A combination according to claim 6 further comprising a biasing roller located in alignment with said track opening and mounted above said platform, and springs urging said biasing roller toward said platform, and said chain passes between said platform and said biasing roller in moving under the control of said reversible drive system, whereby said biasing roller maintains links of said chain at said track opening in close proximity to said platform.

9. A combination according to claim 4 wherein said platform includes a guide slot aligned with said track opening, and said first end of said chain has an end member at its extremity, and said end member has a guide fin depending therefrom, and said guide fin follows said guide slot in said platform when said reversible drive system fully retracts said chain.

10. A combination according to claim 9 further comprising a door attachment hinge connection between said top of said garage door and said guide fin of said link.

11. A combination according to claim 1 wherein said chain links are each formed with upper and lower rectangular plates that are joined together in mutually parallel, spaced relationship from each other, and said plates each have a leading end and a trailing end, and said leading and trailing ends are each configured to define a transverse abutment shoulder and a fastening tab projecting longitudinally beyond said abutment shoulder, and the configuration of said leading ends and that of said trailing ends is mutually complementary, so that said fastening tabs of said leading ends and said fastening tabs of said trailing ends of adjacent links reside in mutually overlying relationship, and are hinged together at corners along a common side of said chain links, whereby said fastening tabs of said leading ends reside in abutment against said abutment shoulders of said trailing ends and said fastening tabs of said trailing ends reside in abutment against said abutment shoulders of said leading ends when said adjacent links are in straight, linear alignment with each other as aforesaid.

12. A combination according to claim 1 further comprising a garage door opener support upon which said track is mounted, and said support has a flat mounting platform with inboard and outboard sides, and a mounting strip extending up from said inboard side of said flat mounting platform, and said mounting strip has hook receiving openings therein and wall mount hinge rods spanning said hook receiving openings, and a mounting bracket secured to said vehicle entry wall and having upwardly turned hooks thereon that project out from said vehicle entry wall, and said hooks engage said wall mount hinge rods to permit a limited degree of rotation of said garage door opener support relative to said mounting bracket.

13. A combination according to claim 12 further comprising a latch on said mounting bracket that interacts with said mounting strip to ensure that said hooks remain engaged with said wall mount hinge rods despite said limited degree of rotation of said garage door opener support relative to said mounting bracket.

14. A combination according to claim 1 wherein said reversible drive system includes a motor having a worm drive shaft, a gear engaged with said worm drive shaft, a sprocket engaged with said chain, and a force transmission shaft to which both said gear and said sprocket are secured.

15. In combination, a garage door and an automatic garage door opener for lifting said garage door from a closed position blocking a garage door opening in a vehicle entry wall and an open position elevated within the interior of a garage, the improvement comprising:

a track secured to said vehicle entry wall above said garage door opening and having a track opening directed away from said vehicle entry wall and toward said garage interior and a curved track section that extends in an arc of at least ninety degrees from said track opening, a drive chain formed of a plurality of links each having a hinged side with corner extremities and an opposing unhinged side, and said links are hinged to each other at said corner extremities of said hinged sides, whereby said links are rotatable in articulated fashion between positions of straight, linear alignment with each other and positions in which said unhinged sides of adjacent links are displaced from each other, and said drive chain has a first end attached to said garage door and a second end that is always engaged with said track, and a reversible drive mechanism engaged with said drive chain to advance said first end of said drive chain into said garage interior so that said links of said drive chain emanate from said track opening in straight, linear alignment with each other within said garage interior beyond said track opening, and alternatively to retract said links of said drive chain onto said track so that said links are drawn into said track opening and follow said track.

16. A combination according to claim 15 in which each of said links is comprised of upper and lower mutually parallel link plates, each having a leading end and a trailing end, and said leading and trailing ends are both configured with longitudinally extending hinge tabs and transversely extending abutment shoulders that delineate said hinge tabs, and said hinge tabs of said leading ends of said chain links are complementary to those of said trailing ends of said chain links, whereby said hinge tabs of said leading ends of said link plates overlap those of said trailing ends of said link plates that are located immediately adjacent thereto, and further comprising hinge connections that extend perpendicular to said link plates and join said link plates together by joining said hinge tabs of adjacent leading and trailing ends of said link plates at said hinged side of said links, so that said longitudinally extending hinge tabs abut against said transversely extending abutment shoulders in chain links that reside in straight, linear alignment as aforesaid, and are displaced from said abutment shoulders at said unhinged sides of adjacent links that are on said curved track section.

17. A combination according to claim 16 wherein each of said link plates has a rectangular shape and is at least about one and one-half inches in length and three-quarters of an inch in width and said link plates in each link are separated by a distance of at least about three-quarters of an inch.

18. A combination according to claim 15 further comprising a rigid mounting support that includes a platform located proximate to said vehicle entry wall and extending toward said interior of said garage, and hinge connections that mount said support to said vehicle entry wall to permit limited rotational movement of said platform relative to said vehicle entry wall about a horizontal platform axis of rotation and said track is located atop said platform and includes a first straight section adjoining said curved track section and located proximate to said vehicle entry wall and extending in a horizontal direction parallel thereto, a one hundred eighty degree bend section connected to said first straight section remote from said curved section, and a second straight section connected to said one hundred eighty degree bend section and spaced from and parallel to said first straight section.

19. A combination according to claim 18 further comprising a suspension link coupling mount projecting upwardly from said platform, and suspension linkage that is attached to said vehicle entry wall above said mounting support and to said suspension link coupling mount at a location thereon spaced from said vehicle entry wall in said interior of said garage, and said suspension linkage includes a platform lift actuating lever that has upper and lower ends with a fulcrum located therebetween, and said lift actuating lever is rotatably coupled at its fulcrum to said suspension link coupling mount for rotation about a horizontal platform lift axis that lies above said platform and which is parallel to said platform axis of rotation, and said suspension linkage further includes a rigid lift stroke control link, one end of which is rotatably connected relative to said vehicle entry wall above said platform axis of rotation and the other end of which is rotatably connected to said upper end of said platform lift actuating lever, and said first end of said drive chain includes a laterally projecting lift actuator lug that contacts said lower end of said platform lift actuating lever and rotates it to thereby raise said platform as said reversible drive mechanism retracts said drive chain and as said first end of said drive chain approaches said track.

20. In combination, a garage door and a garage door opener for automatically raising and lowering said garage door relative to a garage door opening in a vehicle entry wall of a garage having an interior and comprising:

a support platform mounted in said garage interior on said entry wall above said garage door opening, a track located on said support platform and having one open end directed out from said entry wall toward said interior of said garage, a drive chain having links that are joined together in articulated fashion, said links including stops located so as to permit articulated movement of said links between alignment with each other in a straight line and deflection to a single side of said straight line, and said drive chain has a leading end and a trailing end and said leading end has an extremity that is coupled to said garage door and said trailing end is constrained to move within said track, and an electrically operated, bidirectional drive system mounted on said support platform and engaged with said drive chain to move said drive chain between extended and retracted positions relative to said track, and in said extended position said leading end of said drive chain extends linearly out of said open end of said track and away from said support platform and into said interior of said garage and in said retracted position said chain is drawn back onto said track with said extremity of said leading end residing at said open end of said track.

* * * * *